United States Patent [19]

Bonastia et al.

[11] Patent Number: 4,474,540

[45] Date of Patent: Oct. 2, 1984

[54] TUBULAR DIAPHRAGM PUMP

[75] Inventors: James V. Bonastia, Bloomfield, N.J.; Daniel Sugarman, New York, N.Y.

[73] Assignee: Pennwalt Corporation, Philadelphia, Pa.

[21] Appl. No.: 416,610

[22] Filed: Sep. 10, 1982

[51] Int. Cl.[3] ..... F04B 43/10

[52] U.S. Cl. ..... 417/63; 417/388; 417/394; 417/478; 92/93

[58] Field of Search ..... 417/63, 388, 389, 394, 417/478; 92/93

[56] References Cited

U.S. PATENT DOCUMENTS

| | | | |
|---|---|---|---|
| 2,832,294 | 4/1958 | Rippingale | 417/63 X |
| 3,451,347 | 6/1969 | Chimura | 417/394 X |
| 3,551,076 | 12/1970 | Wilson | 417/478 X |

OTHER PUBLICATIONS

"Selecting Diaphragm Metering Pumps", Machine Design, vol. 52, No. 24, Oct. 23, 1980, pp. 88–93.

*Primary Examiner*—Leonard E. Smith

*Attorney, Agent, or Firm*—Antonelli, Terry & Wands

[57] ABSTRACT

The invention is comprised of a hydraulically actuated diaphragm pump having a working diaphragm driven by a piston and a working fluid. The working diaphragm, in turn, actuates a tubular diaphragm through a second hydraulic coupling. Material is pumped through the tubular diaphragm as it is compressed and relaxed. The configuration of the tubular diaphragm is such that its cross section gradually transforms from a circular shape at the end portions adjacent to the suction inlet and discharge outlet of the pump to an elliptical shape at its longitudinal mid-point. Since the inner circumference and wall thickness remain constant throughout the length of the tubular diaphragm the direction of flexure is predetermined. Thus the tubular diaphragm may be positioned within the pump head so as to facilitate the provision of means to view it at its longitudinal mid-point wherein the viewing means sight along the outer wall of the tubular diaphragm and wherein the viewing means define a straight line which is parallel to the major axis of the elliptical cross-section.

20 Claims, 4 Drawing Figures

TUBULAR DIAPHRAGM PUMP

BACKGROUND OF THE INVENTION

The present invention relates generally to hydraulically actuated diaphragm pumps. More particularly, the present invention is directed to an improvement in such pumps by the provision of a tubular diaphragm which is circular in cross-section at each of its end positions in the area of suction and discharge valves and which gradually transforms to an elliptical cross-section at its longitudinal mid-point while the internal circumference and wall thickness remain substantially constant.

As is well known, diaphragm pumps are especially useful for transporting viscous materials and corrosive fluids through pipes. In hydraulically actuated diaphragm pumps this is conventionally accomplished by means of a confined volume of hydraulic fluid exerting pressure on a diaphragm member. Check valves in these pumps limit the motion of the pumped or process material to a single direction so that the diaphragm acts as a positive displacement pump. Two diaphragms may be arranged in series, e.g., a flat diaphragm driving a tubular diaphragm through a coupling fluid, in order to isolate the pumped material from the hydraulic fluid and to permit optimization in the choice of diaphragm materials.

U.S. Pat. Nos. 2,345,693 and 3,318,251 show hydraulically actuated diaphragm pumps with a tubular diaphragm of uniform circular cross-section. However, it has been found that such diaphragms do not flex in any one predetermined direction upon compression. Predictability of the flex direction makes it possible to locate viewing ports in the pump head or casing to observe normal operation. In addition, viewing ports so located may be used to detect leakage of the process material or the working hydraulic fluid into the intermediate coupling fluid.

Oval or elliptical tubes have been proposed in pumps of the type shown in U.S. Pat. Nos. 2,046,491 and 3,451,347. Heretofore, such configurations have not been provided for the purpose of controlling the flex direction as the tubular diaphragm is compressed and relaxed. For example, the pumping system disclosed in U.S. Pat. No. 2,046,491 shows two oval tubes arranged one within the other and oriented so that their major axes are shifted 90°. The direction of flex of the inner oval tube which pumps fuel is controlled by compression blocks actuated by the outer oval tube. The tubular diaphragm or chamber shown in U.S. Pat. No. 3,451,347 has an elliptical cross-section at the longitudinal mid-point but the inner circumference does not appear to remain constant.

Tubular diaphragm pumps known as "MILROYAL" and "mRoy TD" have been described in brochures of the Milton Roy Company in Ivyland, Pa. These pumps are described as having an elliptical tubular diaphragm but do not appear to taper gradually from a circular cross-section at each end to an elliptical cross-section at the longitudinal mid-point while maintaining a constant internal circumference. Instead, Bulletin 35.011 and Product Data brochure PD 15.30 show tubular diaphragms that neck down substantially at each end, thereby abruptly changing the inner circumference.

SUMMARY OF THE INVENTION

By providing a tubular diaphragm of elliptical cross-section at its longitudinal mid-point and of substantially constant inner circumference and wall thickness throughout its length, the present invention will overcome problems and disadvantages inherent in prior art diaphragm pumps.

One object of the present invention is to provide a tubular diaphragm which will flex in a predetermined direction in a pump head.

Another object of the present invention is the provision of a tubular diaphragm which can be installed in the preferred orientation of flexure to permit monitoring of the diaphragm through viewing ports to assure normal pump operation and the absence of leaks.

Still another object of the present invention is the provision of a tubular diaphragm which minimizes the internal volume of the pump head and therefore also reduces the amount of expensive coupling fluid needed in the pump head for displacing the process fluid or pumped material.

A further object of the present invention is to easily permit the tubular diaphragm to be lined with a relatively inexpensively manufactured chemically resistant liner of circular cross-section which can be readily inserted in the diaphragm because it has a constant internal circumference and thereafter can assume the shape of the diaphragm.

BRIEF DESCRIPTION OF THE DRAWINGS

These and further features, objects and advantages of the present invention will become readily apparent from the following description when taken in conjunction with the accompanying drawings which show, for exemplary purposes only, our presently preferred embodiment and wherein.

DETAILED DESCRIPTION OF A PREFERRED EMBODIMENT

Figure 1:
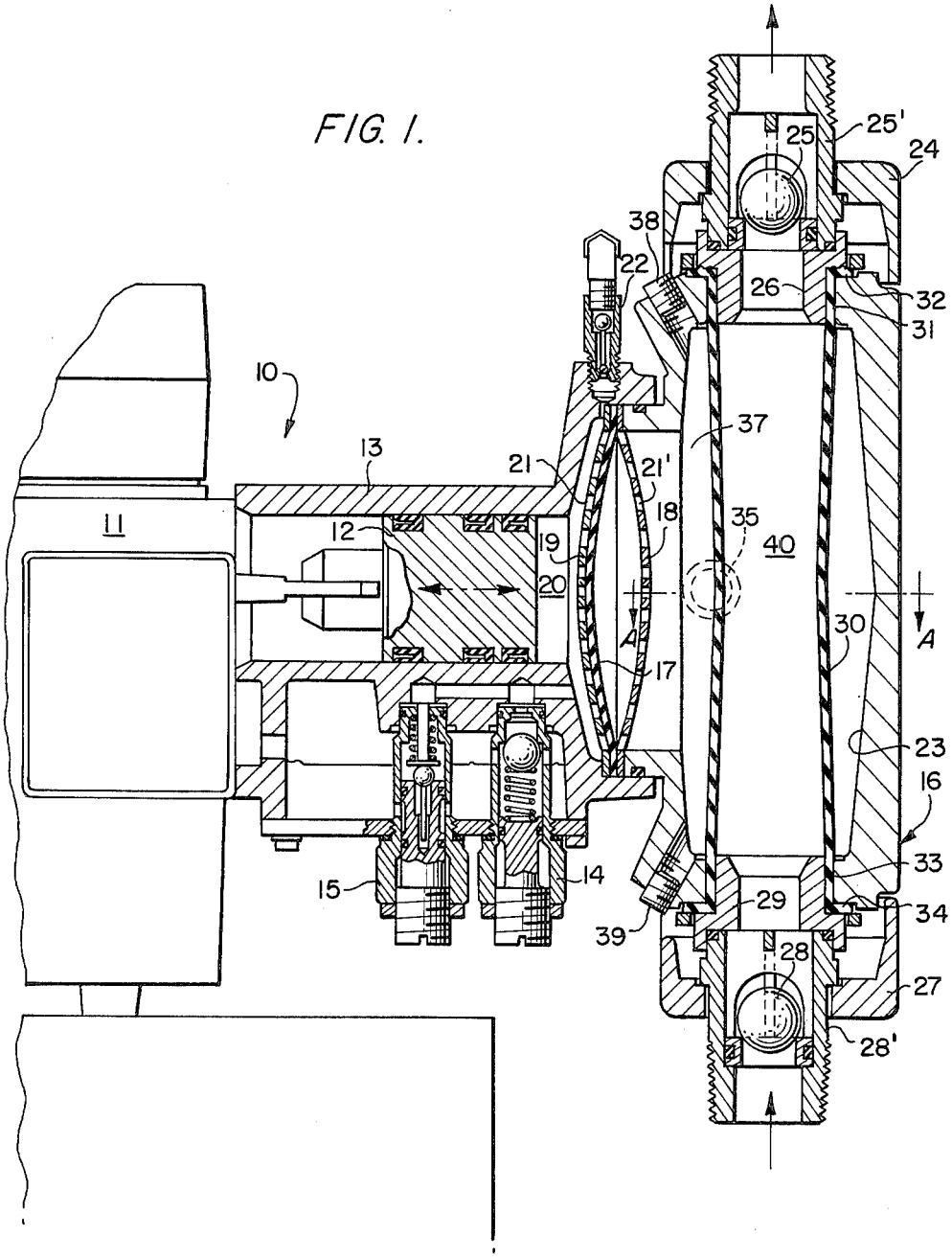
FIG. 1 is a plan view of a diaphragm pump constructed in accordance with the principles of our invention with the pertinent portion of the pump shown in cross-section.

Referring now to the drawings and, in particular, to FIG. 1, there is shown a diaphragm pump designated generally by the numeral 10. The pump 10 includes a conventional power source 11 which operates a reciprocating piston 12 slidably arranged in a cylinder housing 13. The cylinder housing 13 is also provided with an outlet or pressure relief check valve 14 in the form of a ball valve and an inlet or fluid refill check valve 15 also in the form of a ball valve, both valves being associated with a fluid reservoir. A head or casing 16 is sealably connected with the cylinder housing 13. In the area where the housing and casing are joined, a working diaphragm 17 of a disc type is located between a forward apertured support plate 18 and a rear apertured support plate 19. The two apertured support plates limit the movement of the diaphragm 17.

A working hydraulic fluid is provided between the piston 12 and the diaphragm 17. Upon reciprocation of the piston, an exact amount of the fluid 20 commensurate with the length of the piston stroke will be displaced through the apertures 21 located uniformly over the rear plate 19. As a result the diaphragm 17 is moved toward the front plate 18 and then upon retraction of the piston the resultant suction draws the fluid 20 through the apertures 21 to move the diaphragm 17 back toward the rear plate 19. A conventional air purge valve 22 is provided at the highest point in the cylinder housing 13 in the rearward side of rear plate 19 to permit the escape of air which is dissolved in the fluid 20. The volume between front plate 18 and rear plate 19 is slightly larger than the volume of fluid 20 displaced by the maximum stroke of the piston 12 so that the working diaphragm will not normally touch the front plate 18 except during abnormal operation, e.g., excessive suction lift.

The pump head 16 comprises an elongated chamber 23, an end cap 24 at the discharge end, a conventional discharge ball valve 25 with associated housing assembly 25', and an adapter 26 located between the associated assembly 25' and the chamber 23. Appropriate conventional sealing means are provided between the assembly and the adapter, as well as within the assembly itself, to assure that there is no leakage of pumped material. A similar arrangement is provided at the inlet or suction end of the head 16, namely, an end cap 27, a conventional suction or inlet ball valve 28 and housing assembly 28', an adapter 29, and appropriate well-known sealing means. Of course, it is well within the scope of the present invention to employ double ball check valves in lieu of the single ball check valves disclosed herein.

Figure 4:
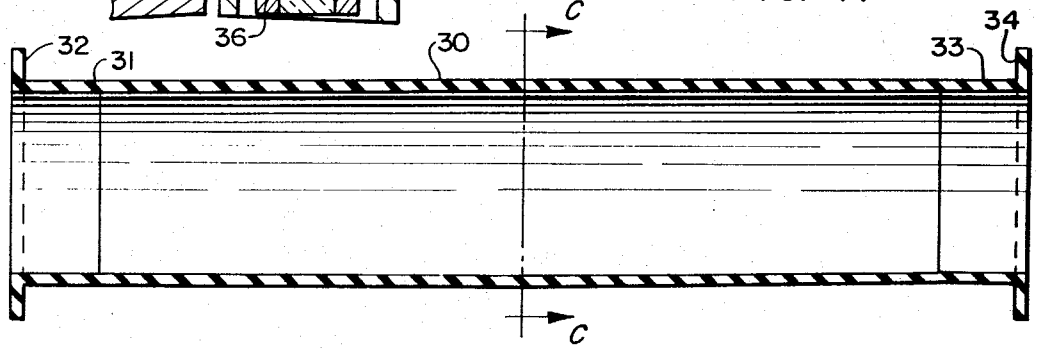
FIG. 4 is a cross-sectional view along the major axis B—B of the tubular diaphragm shown in FIG. 3.
Figure 3:
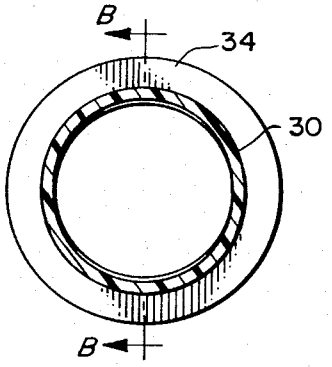
FIG. 3 is an end view of the tubular diaphragm shown in FIGS. 1 and 2 taken along line C—C of FIG. 4.

A flexible tubular diaphragm 30 made, for example, from molded elastomeric compound such as "HYPALON" is arranged in the chamber 23 and surrounded by an intermediate fluid 37. As shown most clearly in FIGS. 3 and 4, this tubular diaphragm 30 is at its longitudinal mid-point elliptical in cross section and gradually transforms to a circular cross-section at the discharge end portion 31 with an integral flange portion 32 and at the inlet end portion 33 with an integral flange portion 34. The ends 31 and 33 with their associated flanges are mounted in such a manner as to provide a seal between the chamber 23 and the adapters 26, 29 respectively. The cross-section of the tubular diaphragm 30 in FIG. 1 is through the minor axis whereas in FIG. 4 the cross-section is taken through the major axis of the ellipse. As is readily apparent from FIG. 1, the tubular diaphragm 30, which is shown in its relaxed or non-compressed state, is gradually tapered along the minor axis in the longitudinal direction toward its central portion from the cylindrical discharge end portion 31 and the cylindrical inlet end portion 32 as a result of maintaining a constant internal circumference. A substantially constant wall thickness is maintained throughout the length of the tubular diaphragm 30.

A proper balance between the piston 12 and the working diaphragm 17 is maintained during operation of the pump by the use of the air purge valve 22, the refill or inlet check valve 15, and the pressure relief check valve 14. Both the relief valve 14 and the refill valve 15 have externally adjustable settings.

Many hydraulic fluids contain entrained vapors. In order to provide accurate metering, these vapors must be purged from the system. On each discharge stroke of the pump, the air purge valve 22 is opened momentarily to allow venting of a small amount of trapped vapor from the working fluid 20. When no vapor is present, a slight amount of fluid is vented.

Since a small amount of fluid 20 is lost during each stroke by means of the air purge valve 22 and through the piston seals (three such seals being shown on piston 12), some provision must be made to replenish the fluid 20 or else the working diaphragm 17 will eventually flatten against the rear plate 19 and some of the remaining fluid will vaporize. To this end the refill valve 15 is provided in one cylindrical housing 13. The setting of this valve must satisfy two criteria. One, the valve must be set for a pressure slightly higher than the vapor pressure of the fluid 20 to prevent its vaporization. The net suction pressure must usually be at least 2 p.s.i. higher than the refill valve setting to avoid a loss in pumping efficiency.

The pressure relief check valve 14 protects both the working diaphragm 17 and the drive portion subjected to thrust forces from overpressure as can occur when the actual suction lift exceeds the design level either by closing a suction line valve or closing a discharge line valve. When excessive suction lift occurs, the setting of the oil refill valve 15 will be exceeded and will allow too much fluid 20 in the area between the piston 12 and the working diaphragm 17. When diaphragm 17 is pressed up against the front plate 18, the overpressure causes the relief check valve 14 to open, thereby relieving the overpressure. In the case of a closed discharge line, the pump will continuously attempt to oppose the static discharge pressure and thereby build up excessive pressure. When the setting of the pressure relief valve 14 is reached, the valve will open and allow fluid 20 to bleed off into the associated reservoir, thereby relieving the excess pressure. If the pump 10 is the only pressure producing component in the system, the pressure relief valve serves as protection for the entire system.

Figure 2:
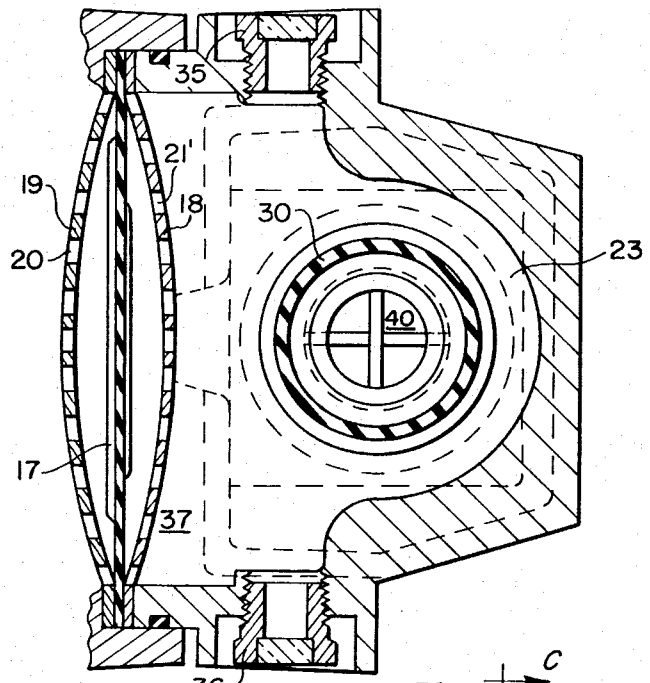
FIG. 2 is a sectional view of the pump head taken along line A—A of FIG. 1.

The tubular diaphragm 30 allows view ports 35, 36, as shown in FIG. 2, to be aligned in the head chamber 23 at the longitudinal mid-point of the tubular diaphragm 30 and sighted along the outer wall of the diaphragm 30 which compresses and relaxes in response to the motion of a fixed amount of an intermediate coupling fluid 37 contained in the head 16 so as to surround diaphragm 30 and bounded by the working diaphragm 17. Threaded plugs 38 and 39 are provided in the head 16 for respectively filling and draining the intermediate fluid 37 which is the hydraulic coupling material which translates the action of the working diaphragm 17 into the compression and relaxation of the tubular diaphragm 30.

In operation, the power source 11 causes the piston 12 to reciprocate within the housing 13 and to force the hydraulic fluid 20 through the apertures 21 of rear apertured plate 19, thereby causing the working diaphragm 17 to move toward the forward support plate 18. As the working diaphragm 17 moves forward, it forces the intermediate fluid 37 through the apertures 21' in the forward plate 18 and causes the tubular diaphragm 30, shown in its relaxed state in FIG. 1, to compress along its minor axis. The compression of the tubular diaphragm 30 causes the inlet ball check valve 28 to seat and the outlet ball check valve 25 to unseat in a known manner so that the process fluid 40 in the tubular diaphragm can be pumped out through the discharge end.

As the piston 12 is reciprocated by the power source 11 in the opposite direction causing the working diaphragm 17 to move toward the rear plate 19, the tubular diaphragm 30 will return to its relaxed or uncompressed position as shown in FIG. 1. At this time, the discharge ball check valve 25 is caused to seat and the inlet ball check valve 28 is caused to unseat in a known manner as a result of suction, thereby drawing process fluid 40 into the tubular diaphragm 30 by suction. In the presently contemplated embodiment of the invention, the tubular diaphragm 30 is not intended to expand beyond its non-compressed condition shown in FIG. 1. To this end, the amount of intermediate fluid 37 is regulated so that when the working diaphragm 17 is adjacent the rear plate 19 the tubular diaphragm 30 is in the position shown in FIG. 1, and when the working diaphragm 17 is adjacent the front plate 18 the tubular diaphragm 30 is compressed to its maximum extent along the minor axis of its elliptical cross-section.

Several advantages result from the use of the novel tubular diaphragm. Since the cross-section of the diaphragm 30 is circular at each end and gradually becomes elliptical at its mid-section, the direction of flex of the tube during compression is predetermined to take place along the minor axis of the ellipse. Known tubular diaphragms of constant circular cross-section and uniform wall thickness do not provide this predictability of flexure deviation. Our invention allows the diaphragm 30 to be installed in a preferred orientation to permit the use of a smaller volume of expensive intermediate or coupling fluid 37 and to permit view ports 35, 36 to be located at the point of maximum tube flexure to observe normal pump operation. Moreover, as the tubular diaphragm 30 flexes it allows light to pass from one viewing port to the other, thereby allowing detection of process fluid 40 or hydraulic fluid 20 in the intermediate fluid 37 which, in turn, would warn of a rupture or leaks in or around the working diaphragm 17 or the tubular diaphragm 30 or both.

The substantially constant internal circumference of the tubular diaphragm 30 allows the diaphragm to be lined, if desired, with a chemically resistant material such as "Teflon" in a simple manner. The liner (not shown) can be made of a constant circular cross-sectional shape for ease of manufacture. However, when installed in the tubular diaphragm the liner will assume the shape of the diaphragm 30.

While we have shown and described a preferred embodiment of our invention, it should be clear that numerous changes and modifications to the disclosed embodiment could be made without departing from our inventive concept. We, therefore, do not intend to be limited to the details shown and described herein, but intend to cover all such changes and modifications as are encompassed within the scope of our appended claims.

We claim:

1. A tubular diaphragm for use in a pump, comprising a longitudinal tubular body with circular end portions which gradually transform to an elliptical cross-section midway between the end portions while the tubular body maintains a substantially constant inner circumference from one end portion to the other end portion.

2. The tubular diaphragm as defined in claim 1, wherein the wall thickness of the tubular body remains substantially constant from one end portion to the other end portion.

3. The tubular diaphragm as defined in claim 1, wherein the end portions have radially extending flanges integrally connected therewith.

4. The tubular diaphragm as defined in claim 1, wherein the body is molded elastomer.

5. In a hydraulically actuated tubular diaphragm pump having a tubular diaphragm with a suction inlet for admitting material to be pumped into the tubular diaphragm under suction and a discharge outlet for pumping the material therein under positive pressure, and a fluid surrounding the tubular diaphragm in a confined space for compressing the tubular diaphragm to pump the material therein through the discharge outlet under the positive pressure and then allowing the tubular diaphragm to relax and create the suction for admitting the material therein through the suction inlet, the improvement comprising providing the tubular diaphragm with end portions of circular cross-section adjacent the suction inlet and discharge outlet, which circular cross-section gradually transforms to an elliptical cross-section midway between the end portions while the inner circumference of the diaphragm remains substantially constant from one end portion to the other end portion.

6. The pump as defined in claim 5, wherein the wall thickness of the diaphragm remains substantially constant from one end portion to the other end portion.

7. The pump as defined in claim 5, wherein the end portions of the diaphragm have radially extending flanges integrally connected therewith for leakproof assembly with the suction inlet and discharge outlet.

8. The pump as defined in claim 5, wherein means are provided for viewing the tubular diaphragm at its longitudinal mid-point.

9. The pump as defined in claim 8, wherein the viewing means sight along the outer wall of the tubular diaphragm.

10. The pump as defined in claim 8, wherein the viewing means define a straight line which is parallel to the major axis of the elliptical cross-section.

11. A hydraulically actuated pump comprising a piston, a working diaphragm, a first confined space defined between the piston and the working diaphragm, a working fluid provided in the first confined space, a pump head with a suction inlet and a discharge outlet, a second confined space defined between the pump head and the working diaphragm, a tubular diaphragm sealingly connected between the suction inlet and the discharge outlet in the pump head, and an intermediate fluid provided in the second confined space and surrounding the tubular diaphragm, wherein the tubular diaphragm has end portions of circular cross-section adjacent the suction inlet and discharge outlet, which circular cross-section gradually transforms to an elliptical cross-section at the longitudinal mid-point of the diaphragm while the inner circumference of the tubular diaphragm remains substantially constant from one end portion to the other end portion.

12. The pump as defined in claim 11, wherein the wall thickness of the tubular diaphragm remains substantially constant from one end portion to the other end portion.

13. The pump as defined in claim 11, wherein oil refill valve means is operatively associated with the first confined space and the working fluid therein.

14. The pump as defined in claim 11, wherein pressure relief valve means is operatively associated with the first confined space and the working fluid therein.

15. The pump as defined in claim 11, wherein air purge valve means is operatively associated with the first confined space and the working fluid therein.

16. The pump as defined in claim 11, wherein means are provided in the first and second confined spaces for limiting movement of the working diaphragm.

17. The pump as defined in claim 11, wherein the suction inlet and discharge outlet have ball valve assemblies operatively associated therewith.

18. The pump as defined in claim 11, wherein means are provided for viewing the tubular diaphragm at its longitudinal mid-point.

19. The pump as defined in claim 18, wherein the viewing means sight along the outer wall of the tubular diaphragm.

20. The pump as defined in claim 18, wherein the viewing means define a straight line which is parallel to the major axis of the elliptical cross-section.

* * * * *